US006376788B1

(12) United States Patent
Jones et al.

(10) Patent No.: US 6,376,788 B1
(45) Date of Patent: Apr. 23, 2002

(54) MAGNETICALLY COLLAPSIBLE TOGGLE LINKAGE FOR ELECTRICAL SWITCHING APPARATUS

(75) Inventors: William John Jones, Cranberry; Perry Robert Gibson, Beaver Falls; James Jeffery Benke, Pittsburgh, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/756,564

(22) Filed: Jan. 8, 2001

(51) Int. Cl.[7] ..... H01H 33/00

(52) U.S. Cl. ..... 200/244; 218/32; 218/146; 335/8; 335/196

(58) Field of Search ..... 200/244, 400, 200/401; 218/1, 16, 17, 19, 20, 22, 146, 30–33; 335/8–16, 196, 200, 201, 203

(56) References Cited

U.S. PATENT DOCUMENTS

| | | | | | |
|---|---|---|---|---|---|
| 4,636,762 | A | | 1/1987 | Marquardt et al. | 335/195 |
| 4,764,650 | A | | 8/1988 | Bur et al. | 200/153 G |
| 4,931,602 | A | * | 6/1990 | Toda et al. | 218/153 |
| 5,025,236 | A | * | 6/1991 | Miura et al. | 335/202 |
| 5,210,385 | A | | 5/1993 | Morel et al. | 200/146 R |
| 5,874,699 | A | | 2/1999 | Beck et al. | 200/244 |
| 5,898,146 | A | * | 4/1999 | Beck et al. | 200/244 |
| 5,899,323 | A | | 5/1999 | Rakus | 200/244 |
| 5,969,314 | A | * | 10/1999 | Rakus et al. | 218/14 |
| 6,005,206 | A | | 12/1999 | Rakus et al. | 200/244 |
| 6,049,051 | A | * | 4/2000 | Dosmo et al. | 218/155 |
| 6,066,821 | A | | 5/2000 | Wehrli, III et al. | 200/552 |
| 6,222,143 | B1 | * | 4/2001 | Lawson et al. | 200/401 |

* cited by examiner

*Primary Examiner*—Michael Friedhofer
(74) *Attorney, Agent, or Firm*—Martin J. Moran

(57) ABSTRACT

An electromagnetic blow-open device for a pole of a circuit breaker where the pole has a stationary contact and a movable contact. The movable contact includes contact fingers mounted on a contact carrier. The contacts have an open position and a closed position. The pole further has an associated rotatable pole shaft. The electromagnetic blow-open device includes a collapsible linkage having a rigid position and a changeable position. The collapsible linkage is disposed between, and coupled to, the pole shaft and contact carrier. The collapsible linkage is maintains the stationary contact and the movable contact in the closed position while the collapsible linkage is in the rigid position and to allow the stationary contact and the movable contact to move to the open position when the collapsible linkage is in said changeable position. The electromagnetic blow-open device also includes an actuator arm which is coupled to the collapsible linkage and is responsive to an over-current condition in the pole. The actuator arm is structured to shift the collapsible linkage from the rigid position to the changeable position.

34 Claims, 17 Drawing Sheets

MAGNETICALLY COLLAPSIBLE TOGGLE LINKAGE FOR ELECTRICAL SWITCHING APPARATUS

BACKGROUND OF THE INVENTION

FIELD OF THE INVENTION

This invention relates to an electrical switching apparatus and, more specifically, to an electrical switching apparatus having a magnetic blow-open device.

BACKGROUND INFORMATION

Electrical switching apparatus for power distribution systems includes devices such as, but not limited to, circuit breakers, network protectors and transfer switches. Circuit breakers include both power circuit breakers and current limiting circuit breakers. A power circuit breaker is typically disposed upstream of other circuit breakers and is structured to delay its tripping action allow a limited fault current to pass therethrough. This allows the downstream circuit breaker closer to the fault to trip. If the fault current is not interrupted by a downstream circuit breaker, the power circuit breaker will trip. Power circuit breakers, however, are unable to withstand very high, e.g. greater than 150 kA, fault currents. For such higher ratings, a current limiting circuit breaker is used. A current limiting circuit breaker is structured to open within a few milliseconds after experiencing a very high fault current, thus limiting the fault current to a value much less than the available prospective peak value.

One type of current limiting circuit breaker is a "fused" current limiting circuit breaker. A fused current limiting circuit breaker uses the current limiting action of series connected current limiting fusses to achieve the required rapid response. This allows the circuit breaker to open at a slower rate, i.e. similar to a power circuit breaker. It would be desirable to have a "fuseless" current limiting circuit breaker.

A common type of power air circuit breaker has a molded casing housing and multiple pole assemblies all driven by a common operating mechanism through a rotatable pole shaft. Each pole includes a contact arm carrier pivoted by a pole arm on the pole shaft between closed and open positions. The contact arm carriers support contact arms having movable contacts which engage stationary contacts with the contact arm carrier in the closed position. Typically, the contact arm is made up of a number of contact arm laminations or fingers mounted on a common pivot pin on the carrier. Contact springs bias the contact fingers against the stationary contacts in the closed position to provide contact pressure and to accommodate for wear. As the movable contact carrier is closed, typically by a spring operated closing and/or reset mechanism, the contact springs are compressed.

Typically, the switching apparatus is structured so that all of the movable contacts are held against the stationary contact by a mechanical force. The mechanical force is sufficient to overcome the electromagnetic force created by current flowing through the contacts and the force of the compressed contact springs. To open the circuit breaker, the mechanical force is released and the all of the contacts are separated. Separation of the contacts is caused by the contact springs expanding. As the contact springs expand, the movable contact carrier is moved away from the stationary contact. By the time the contact springs are fully expanded, the movable contact carrier has enough momentum to pull the contact arm fingers away from the stationary contact.

When a large over-current is present, the separation of the contacts is also aided by the electromagnetic repulsion force between the stationary and movable contacts.

The prior art release mechanism included a rotatable pole shaft having a lobe that was coupled by a link assembly to the movable contact carrier. The link assembly included a rigid link member disposed between the pole shaft and the contact carrier. The combination of the pole shaft and the link assembly created the mechanical force that held the movable contact carrier in place. The release mechanism was structured so that the pole shaft rotated causing the lobe to move away from the stationary contact. As the lobe moved away from the stationary contact, the mechanical force was released and the contact springs moved the movable contact away from the stationary contact. The link assembly was rotatably attached to both the pole shaft and the movable contact. Thus, movement of the contact carrier was always associated with the rotation of the pole shaft. The link assembly was not structured to have a knee joint or otherwise be flexible.

From the perspective of a current limiting circuit breaker, the prior art release mechanism has several disadvantages. First, the release mechanism was generally structured to release all poles of the switching apparatus at one time. Second, the release mechanism did not respond rapidly to an over-current position. Additionally, power circuit breakers can not be easily converted into current limiting circuit breakers There is a need, therefore, for a release mechanism that allows for each pole of a multi-pole switching apparatus to separate as soon as an over-current condition occurs in that pole.

There is a further need for a release mechanism having a rapid response time.

There is a further need for a release mechanism that can be integrated with existing switching apparatus. There is a further need for a release mechanism that can be incorporated into a power circuit breaker to convert the power circuit breaker into a current limiting circuit breaker.

SUMMARY OF THE INVENTION

This need and others are satisfied by the invention which is directed to electrical switching apparatus in which an electromagnetic blow-open device is incorporated into the assembly connecting the pole shaft to the movable contact.

The electromagnetic blow-open device includes a link assembly having a first link member and a second link assembly which are rotatably coupled to each other at a knee joint. The electromagnetic blow-open device also includes an actuating arm coupled to the fist and second link assemblies at the knee joint. The rotation of the first and second link assemblies relative to each other is limited by a stop means. Thus, when assembled, the first and second link assemblies may not rotate past a certain point. When the switching device is closed, or reset, the first and second links are brought to the point where no more rotation is possible. This is the over-toggle position of the link assembly. The link assembly is held in the over-toggle position by the force biasing the movable contact away from the stationary contact. This force includes both the electromagnetic repulsion force between the contacts, when current is flowing, and the force of the contact springs on the movable contact carrier.

The actuating arm includes a flapper assembly. The flapper assembly is, generally, a flat member of ferromagnetic material which extends adjacent to the contact arm fingers on the movable contact carrier. As a current passes through the contact arm fingers a magnetic field is created. The magnetic field attracts the flapper assembly. Under normal operating conditions, the magnetic field is not strong enough to overcome the force of the contact springs holding the link assembly in the over-toggle position. When an over-current condition occurs, the strength of the magnetic field increases and draws the flapper assembly towards the contact arm fingers. As the flapper is drawn toward the contact arm fingers, the actuating arm acts on the knee joint causing the first and second links to move back through the toggle position. Once the first and second links are out of the over-toggle position, the linkage will collapse and the movable contact carrier is free to move away from the stationary contact. Separation of the contacts is assisted by the force of the contact springs expanding and the magnetic field generated by the fault current.

Thus, when the link assembly moves out of the over-toggle position, the contact carrier moves away from the stationary contact without the pole shaft rotating. The time-current characteristics of the trip unit are coordinated with the tripping action of the blow-open device, so that, when a pole opens, the release mechanism for the remaining poles is actuated. Opening the circuit breaker with the poleshaft also acts to reset the blow-open device by moving the link assembly back into the over-toggle position. Resetting the release mechanism will maintain the link assembly in the over-toggle position even when the blow-open device has not been activated, e.g., after the circuit breaker is manually opened.

Using this electromagnetic blow-open device allows one to change a power circuit breaker into a current limiting circuit breaker simply by installing the electromagnetic blow-open device in place of the prior art link assembly.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE PREFERRED EMBODIMENT

The invention is applicable to electrical switching apparatus such as, for example, circuit breakers, network protectors, transfer switches and disconnect switches, and will be described as applied to a power circuit breaker. The circuit breaker depicted is similar to the circuit breaker shown in U.S. Pat. No. 6,066,821, which is incorporated by reference.

Figure 1:
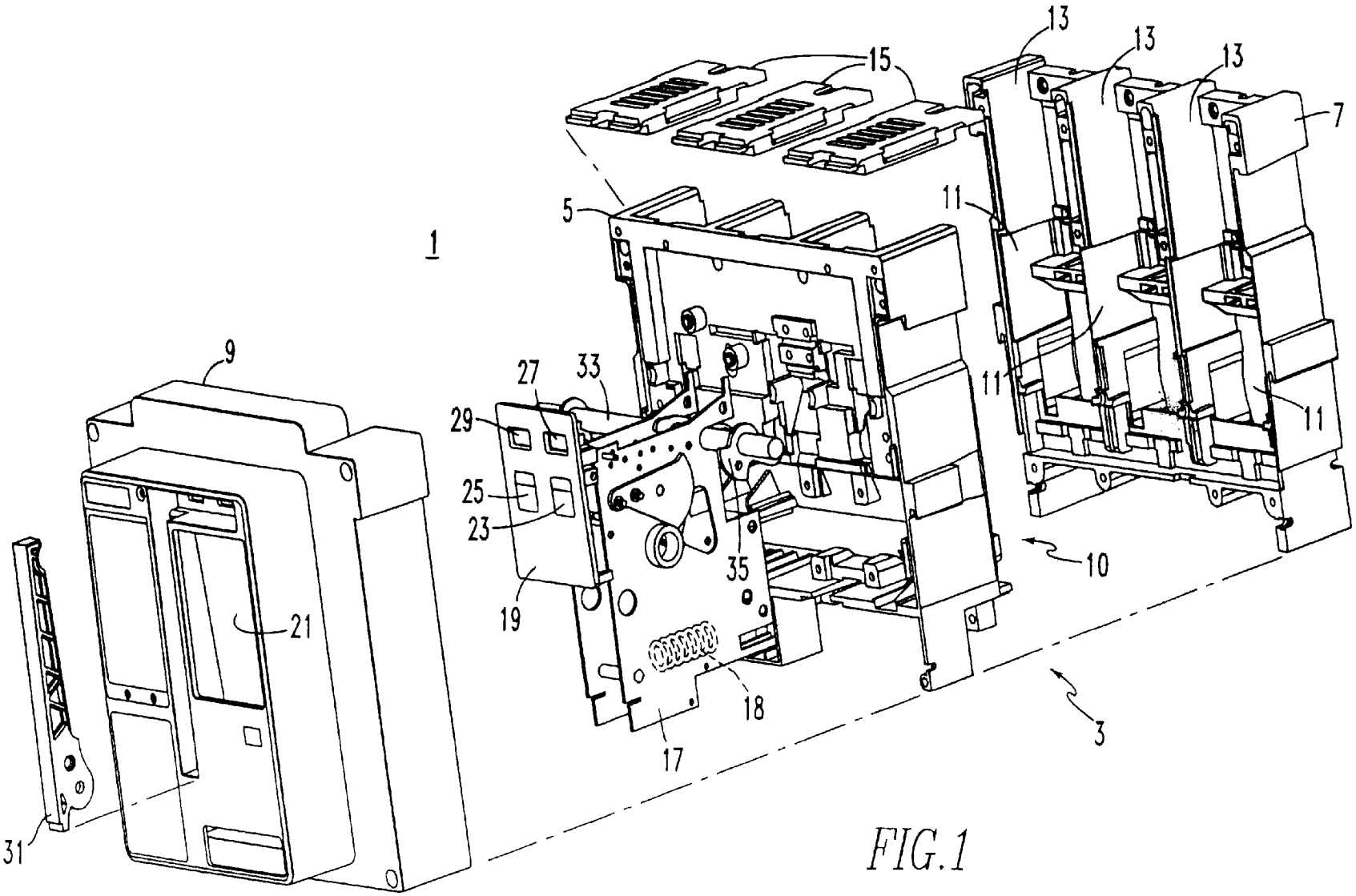
FIG. 1 is an exploded isometric view of a power air circuit breaker incorporating the invention.

Referring to FIG. 1, the power air circuit breaker 1 incorporating the invention has a housing 3 which includes a molded front casing 5 and rear casing 7, and a cover 9. The exemplary circuit breaker 1 has three poles 10 with the front and rear casings 5, 7 forming three pole chambers 11. Each pole 10 also has an arc chamber 13 which is enclosed by a ventilated arc chamber cover 15.

The circuit breaker 1 has an operating mechanism 17 which is mounted on the front of the front housing 5 and is enclosed by the cover 9. The operating mechanism 17 has a front face 19 which is accessible through an opening 21 in the cover. The operating mechanism 17 includes a large spring 18 which is charged to store energy for closing the circuit breaker. The face plate 19 mounts a push to close button 23 which is actuated to discharge the close spring for closing the circuit breaker and a push to open button 25 for opening the circuit breaker. Indicators 27 and 29 display the condition of the charge spring and the open/close state of the contacts, respectively. The charge spring is charged by operation of the charging handle 31 or remotely by a motor operator (not shown).

The common operating mechanism 17 is connected to the individual poles by a pole shaft 33 having a lobe 35 for each pole. As is conventional, the operating mechanism 17 includes a trip unit (not shown) which actuates the operating mechanism to open all the poles of the circuit breaker through rotation of the pole shaft 33 in response to predetermined characteristics of the current flowing through the circuit breaker.

Figure 2A:
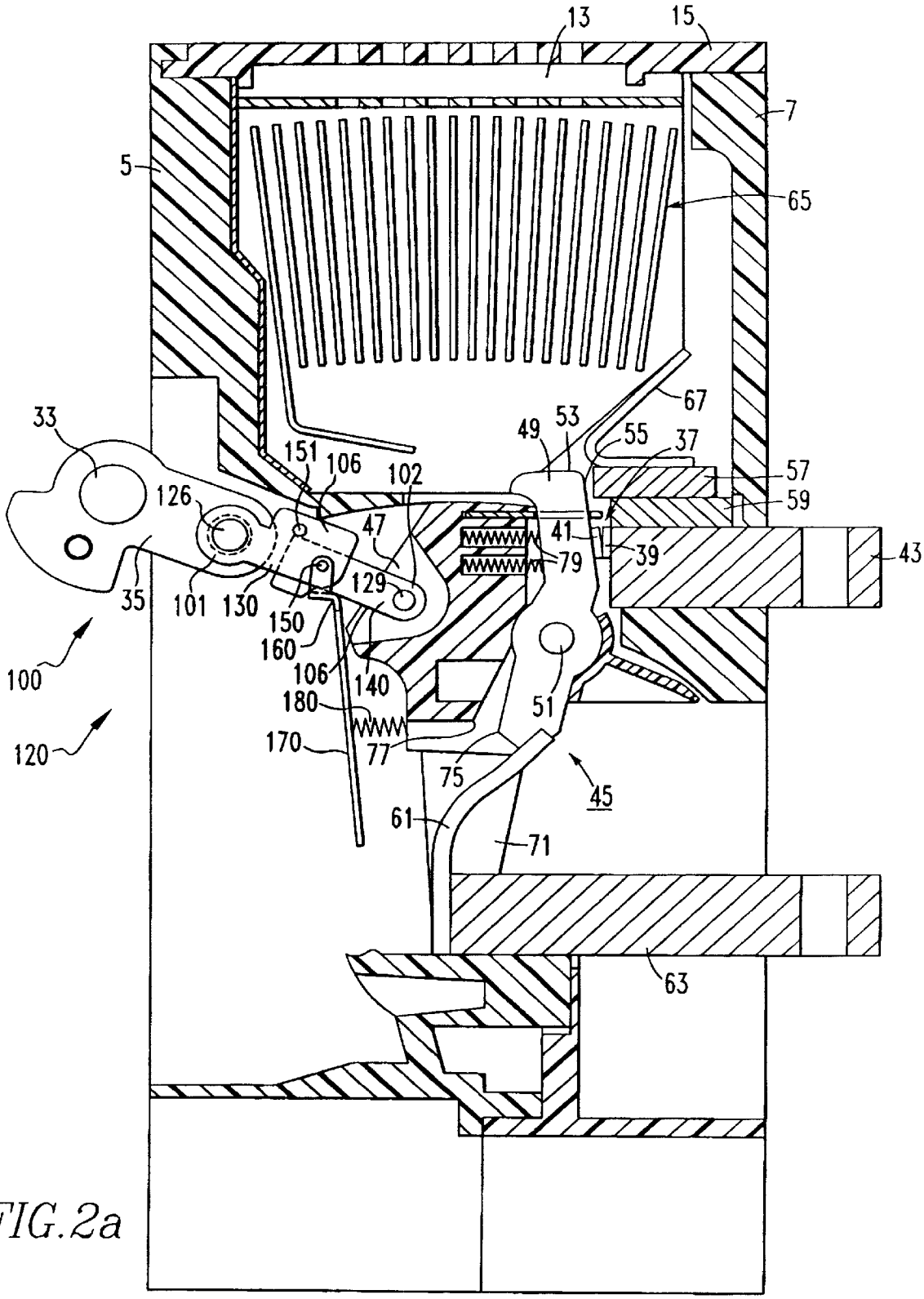
FIG. 2*a* is a vertical section through the circuit breaker of FIG. 1 shown in the filly closed position.
Figure 2B:
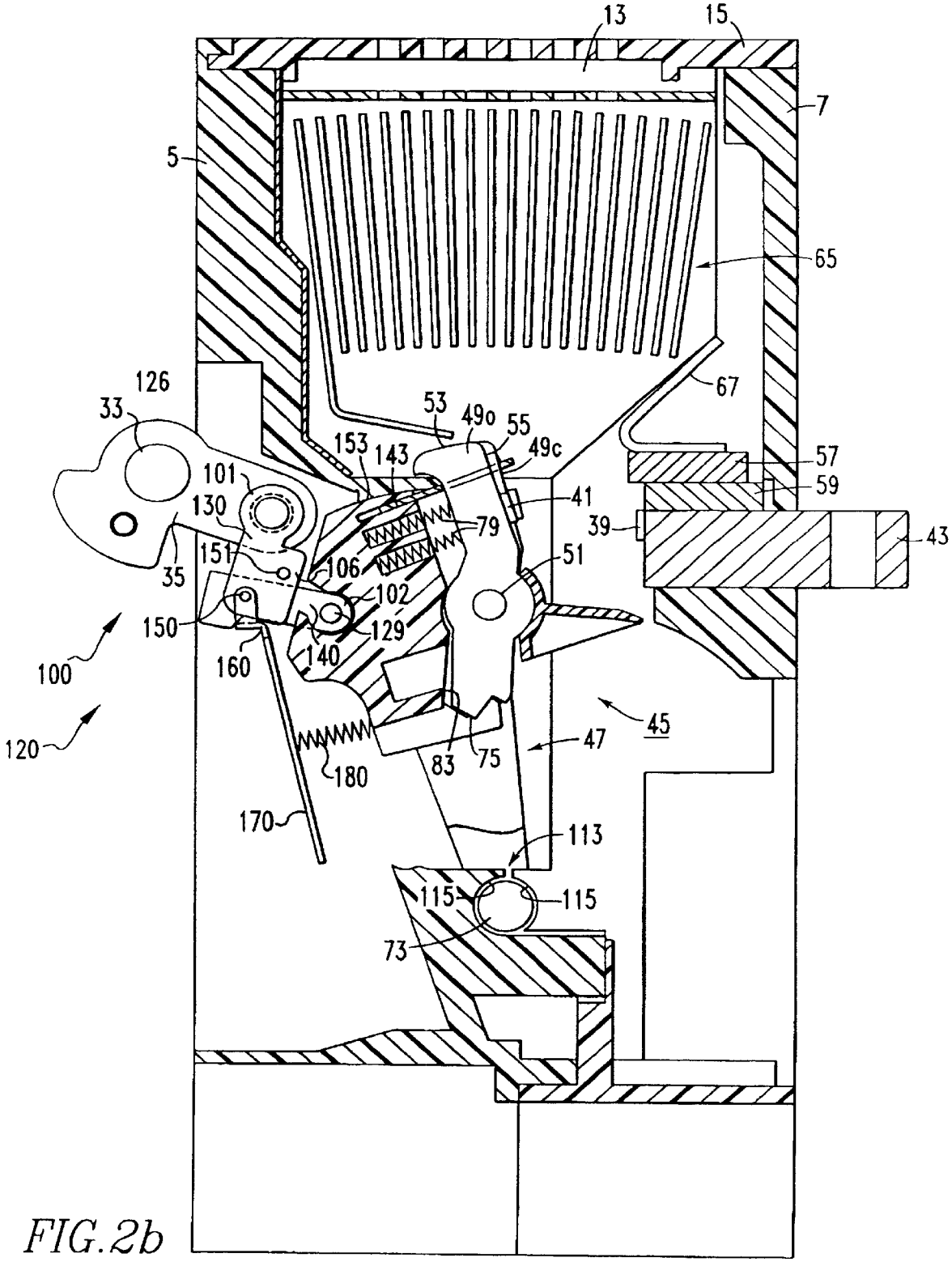
FIG. 2*b* is similar to FIG. 2*a* but illustrating the electromagnetic blow-open device in the collapsed position.
Figure 2C:
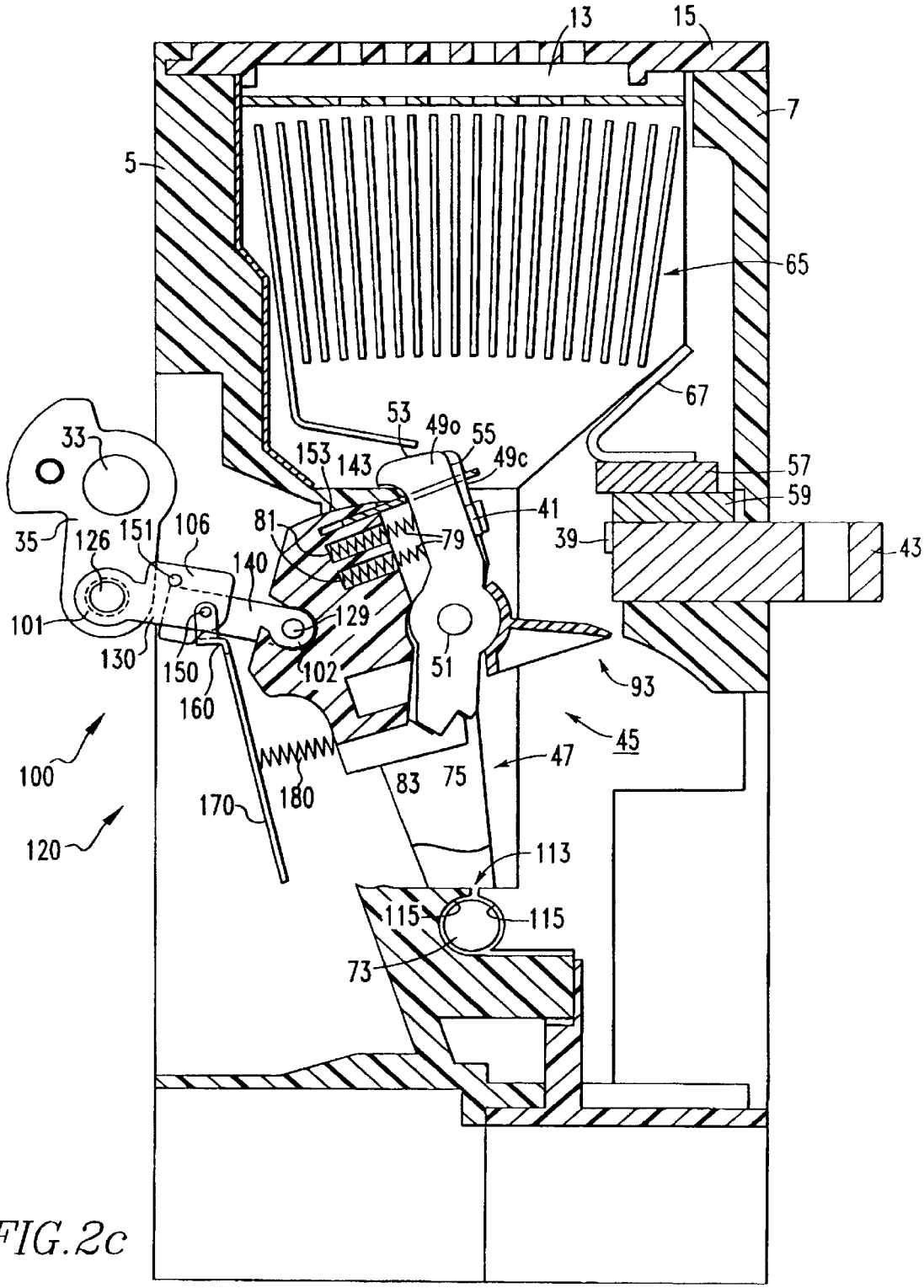
FIG. 2*c* is similar to FIG. 2*a* but illustrating the electromagnetic blow-open device in the reset position.

As illustrated in FIGS. 2*a*–2*c*, each pole of the circuit breaker 1 includes separable main contacts 37 comprising stationary main contacts 39 and movable main contacts 41. The stationary main contacts 39 are secured to a line conductor 43 which is mounted in and projects rearwardly from the rear casing 7. The movable main contacts 41 are mounted on a moving conductor assembly 45. This assembly includes a contact carrier 47 on which a plurality of contact fingers 49 are pivotally mounted by a pivot pin 51. The movable main contacts 41 are fixed to the contact fingers 49 about midway between the pivot pin 51 and a first or free end 53. Adjacent to the free end 53 of the contact fingers is an arc toe 55 forming a movable arcing contact which cooperates with a toe block 57 forming a stationary arcing contact secured to the line conductor through an electrically conductive spacer 59 to form a set of arcing contacts.

The moving conductor assembly 45 further includes flexible shunts 61 connecting the contact fingers 49 to a load conductor 63 also projecting rearwardly from the rear casing 7. As is conventional, an arc chute 65 is provided in the arc chamber 13. An arc runner 67 guides the arc from the toe block to the arc chamber where it is extinguished in a known manner.

Figure 3:
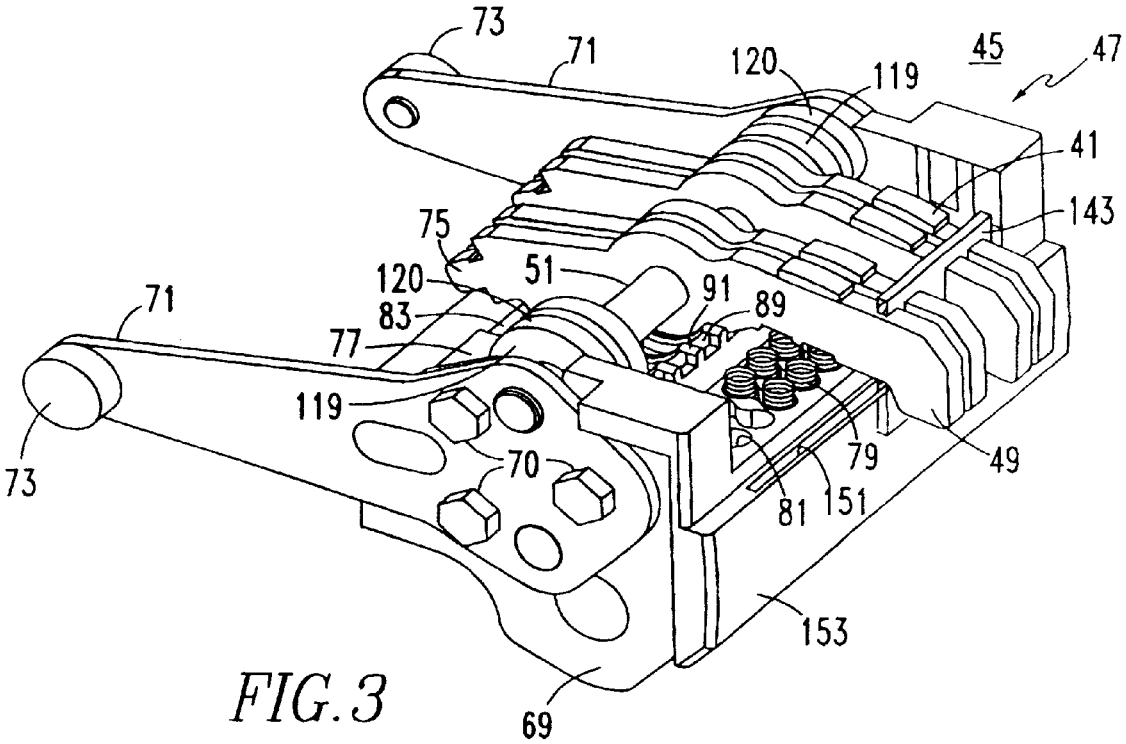
FIG. 3 is an isometric view of the contact carrier which forms part of the circuit breaker with some parts eliminated for clarity.
Figure 4:
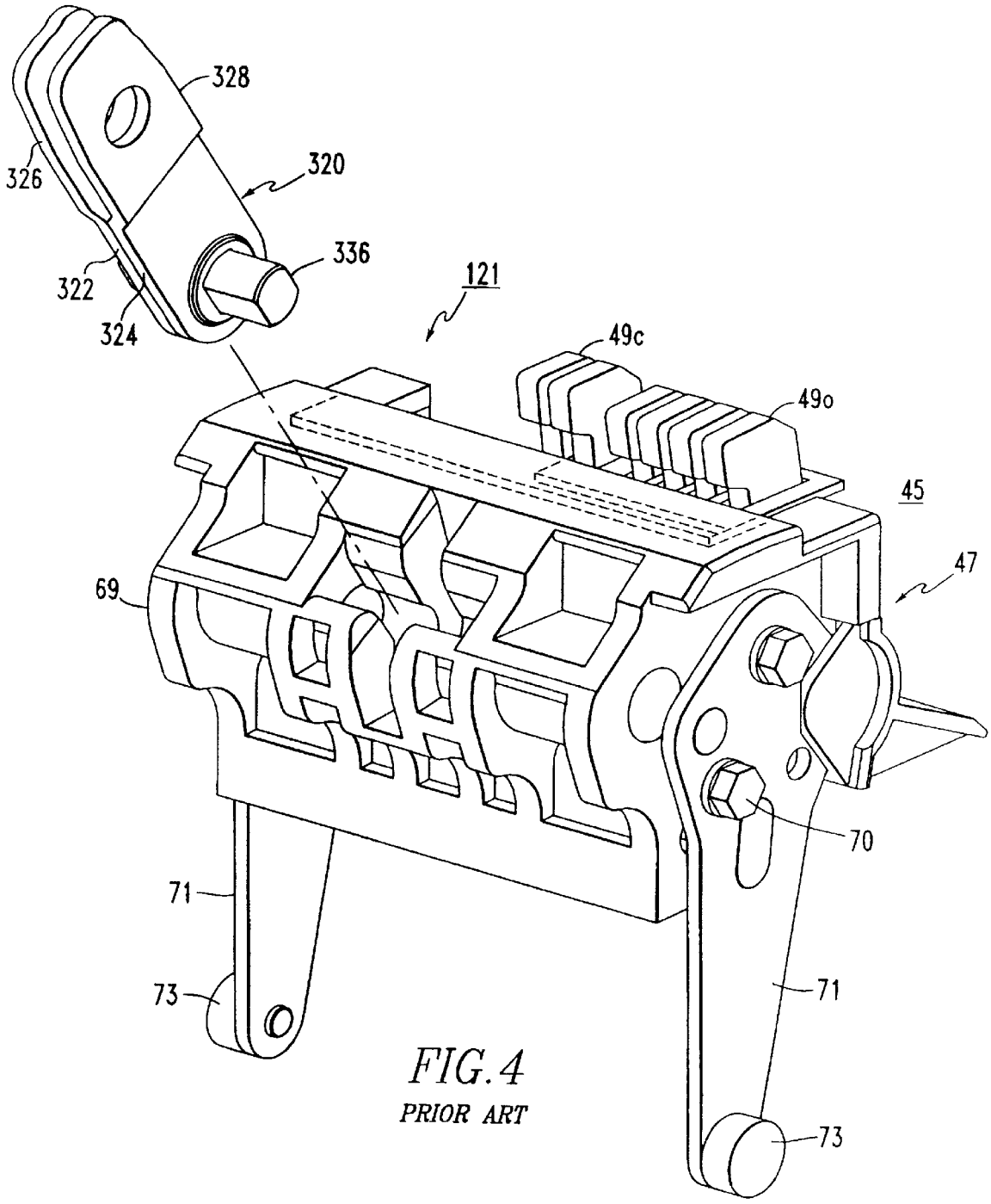
FIG. 4 PRIOR ART
FIG. 4 is an isometric view of the prior art drive link assembly engaging the carrier.

Turning to FIGS. 3 and 4 in addition to FIGS. 2*a*–2*c*, the contact carrier 47 includes a molded body 69 and a pair of legs 71 secured to the ends of the body 69 by bolts 70. Mounting pivots 73 project outwardly from the free ends of the legs 71. The pivot pin 51 is supported at its ends in the legs 71. The contact fingers 49 are pivotally mounted on the pivot pin 51. Second ends 75 of the contact fingers 49 are biased against a stop ledge 77 on the molded body 69 by a pair of contact springs 79 seated in recesses 81 in the molded body. The stop ledge 77 has a contour which includes a recessed section 83 in the center of the stop ledge. This allows the contact springs 79 to rotate the center contact fingers which are aligned with the recess 83 to project the first or free ends 53 further from the contact carrier than the other, outside, contact fingers.

As shown in FIG. 2*c*, the contact carrier 47 is pivotally mounted for rotation to open and close the separable contacts 37. Bearing pockets 113 are formed by mating recesses 115 in the front casing 5 and rear casing 7 for the pivot 73 on the free ends of the legs 71. The carrier 47 is rotated about the pivots 73 by a link assembly 120 pivotally connected to the pole lobe 35 on the pole shaft 33.

Generally, the operation of the circuit breaker 1 when being opened by the tripping mechanism is as follows: with the contact carrier 47 rotated to the fully closed position shown in FIG. 2*a*, the separable contacts 37 are closed to complete a circuit which includes the line conductor 43, the fixed contacts 39, the movable contacts 41, the contact arms 49, the flexible shunts 61 and the load conductor 63. In this fully closed position, the arcing contacts are open. Also, in the fully closed position the second ends 75 of the contact arms are spaced from the stop ledge 77. The contact springs 79 maintain contact pressure between the fixed and movable contacts 39, 41.

As the circuit breaker begins to open, the contact carrier 49 begins to rotate counterclockwise to the position shown in FIG. 2*b*. In this position, with the carrier slightly spaced counterclockwise from the position in FIG. 2*a*, the contact springs 79 rock the contact fingers 49 clockwise so that they rock about the separable contacts 37 and close the arcing contacts. At this point, current flows both through the closed separable contacts and arcing contacts. As the contact carrier continues its counterclockwise rotation during opening and reaches a position where the separable contacts have separated. In addition, the second ends 75 of the outer contact fingers have seated on the stop ledge 77 and are therefore rotated with the carrier to open the associated arcing contacts as well as the separable contacts. However, the second ends of the center contact fingers 49*c* enter the recess 83 in the stop ledge 77 and therefore can continue to rotate and maintain the center arcing contacts closed. Continued rotation of the carrier 47 in the counterclockwise direction then results in the drawing of an arc between a toe block 57 and the arc toes 55*c* on the center contact fingers only. This arc is then transferred by the arc runner 67 to the arc chute 65 where it is extinguished.

FIG. 2*c* shows the carrier in the fully open position with the center contact fingers 49*c* advanced. Thus, as the carrier 47 moves to the closed position during the next closing cycle, the arcing contacts of the center contact arms will touch first followed by the arcing contacts of the outer contact fingers. This will cause the contact fingers to rock to the position shown in FIG. 2*b* where both the arcing contacts and the separable contacts are closed. As the carrier reaches the fully closed position of FIG. 2*a*, the arcing contacts separate and all the current flows through the closed separable contacts 37.

The prior art link assembly 320 is shown in FIG. 4. The prior art link assembly included two rigid link members 322, 324 having offset ends 326, 328. The offset ends 326, 328 straddled the pole lobe 35 and were connected to the pole lobe 35 by a pin. The non-offset ends 332, 334 of rigid link members 322, 324 were coupled by a drive pin 336 to the carrier 47.

As shown in FIG. 2*a*, the electromagnetic blow-open device 120 includes a collapsible linkage 100 having a first end 101 and a second end. 102. The collapsible linkage 100 has a rigid position and a changeable position. In the rigid position, the collapsible linkage 100 has a generally fixed length between the first end 101 and the second end 102. In the changeable position, the first end 101 and the second end 102 may be drawn together. The collapsible linkage 100 is disposed between, and coupled to, the pole shaft 33 and contact carrier 47. The electromagnetic blow-open device 120 further includes an actuator arm 160 coupled to the collapsible linkage 100. The actuator arm 160 is structured to be responsive to a large over-current in the 10 pole. When an over-current condition occurs, the actuator arm 160 shifts the collapsible linkage 100 from the rigid position to the changeable position. Thus, the collapsible linkage 100 is structured to maintain the stationary contact 39 and the movable contact 41 in the closed position while the collapsible linkage 100 is in the rigid position and to allow the stationary contact 39 and movable contact 41 to move to the open position when the collapsible linkage 100 is in said changeable position. Additionally, the main contacts 37 separate without the pole shaft 33 rotating.

Figure 5:
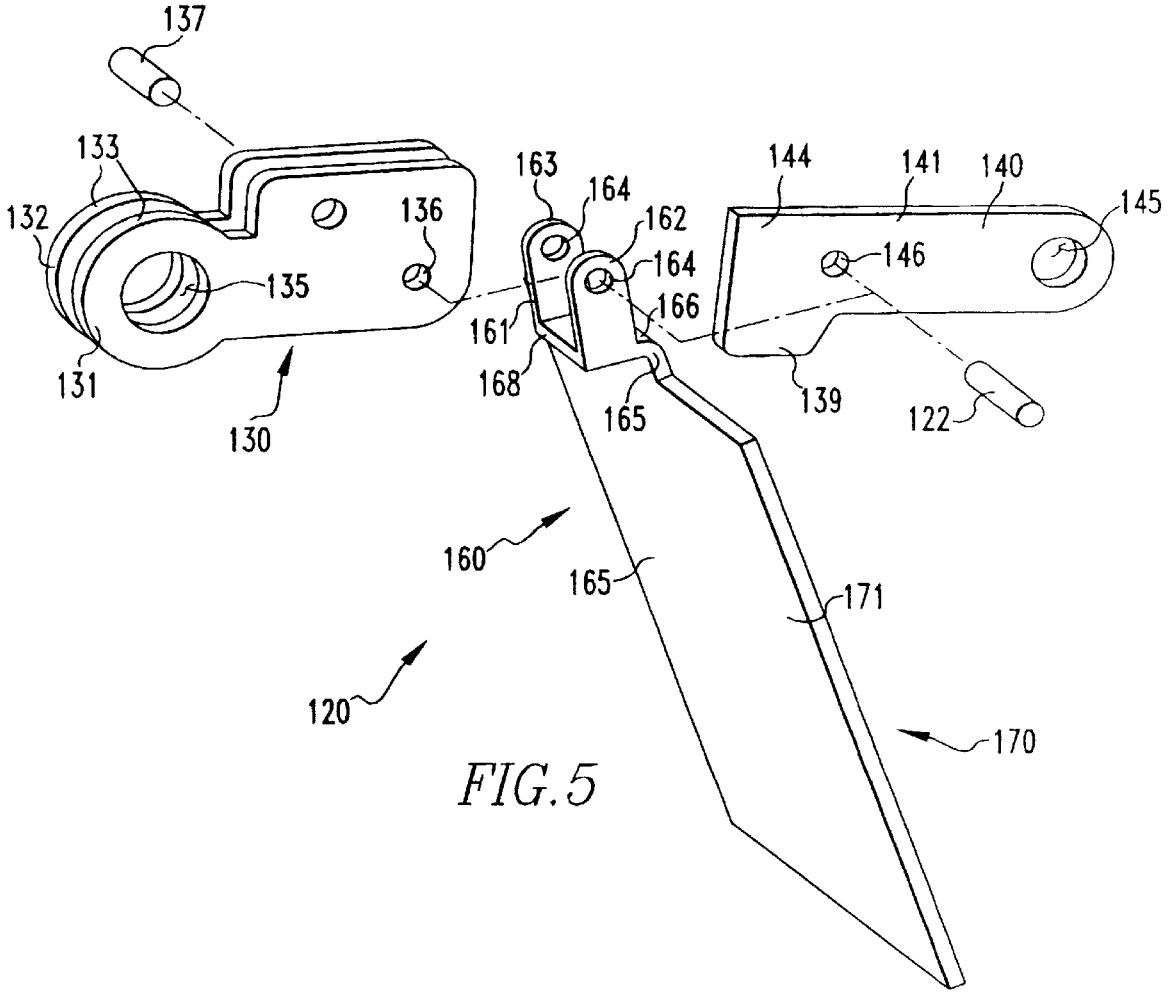
FIG. 5 is an exploded, isometric view of the electromagnetic blow-open device.

The embodiment of the electromagnetic blow-open device 120 shown in FIG. 5 includes a plurality of link elements 106. One of the link elements 106 includes and over-toggle stop 108. When an adjacent link contacts the over-toggle stop 108, the links are in an over-toggle position. When the link elements 106 are in the over-toggle position, the collapsible linkage 100 is in the rigid position. The interaction between the link elements 106 and the actuator arm 160 is set forth in more detail below. There are other types of collapsible linkages available. For example, the collapsible linkage 100 could be a telescoping member held in place by a detent. In this configuration, the actuator arm 160 releases the pressure on the detent and allows the telescoping member to collapse.

As shown in FIG. 5, the link elements 106 include a first link assembly 130 and a second link assembly 140 which are rotatably coupled to each other at a knee joint 150 (FIG. 6) by a pivot pin 122. The first link assembly 130 includes two rigid planar members 131, 132. Each rigid planar member 131, 132 has a first end 133 and a second end 134. Both the first end 133 and the second end have an opening 135, 136, respectively, therein structured to allow a pin to pass through either rigid planar member 132, 134. The rigid planar members 132, 134 are coupled to, and held in a spaced, generally parallel relation by, a over-toggle stop pin 137 disposed in the medial portion of each rigid planar member 132, 134 through a stop pin opening 138.

The second link assembly 140 includes a rigid planar member 141. The rigid planar member 141 has a first end 143 and a second end 144. Both the first end 143 and the second end have an opening 145, 146 therein structured to allow a pin to pass through either the rigid planar member 142. The planar member second end 144 includes a tab 139 that extend in a direction toward the flapper assembly 170, described below.

The electromagnetic blow-open device 120 also includes a actuator arm 160. The actuator arm includes an attachment end 161 having a two tabs 162, 163 each with an opening 164 therethrough. The two tabs 162, 163 are, preferably, spaced to fit on the outer sides of the first link assembly 130. The tabs 162, 163 are maintained in a spaced relation by crossbar 168. The actuator arm 160 further includes a shoulder portion 165 having at least one shoulder 166. The shoulder 166 preferably extend from crossbar 168 in a direction perpendicular to the longitudinal axis of the tabs 162, 163 so that a portion of the shoulder 166 is not in the same plane as the longitudinal plane of the tabs 162, 163. The shoulder portion 165 may be integral to a flapper assembly 170. The flapper assembly 170 is preferably a flat, rigid metallic member 171. However, as described below, the flapper assembly 170 may have many shapes.

Figure 6:
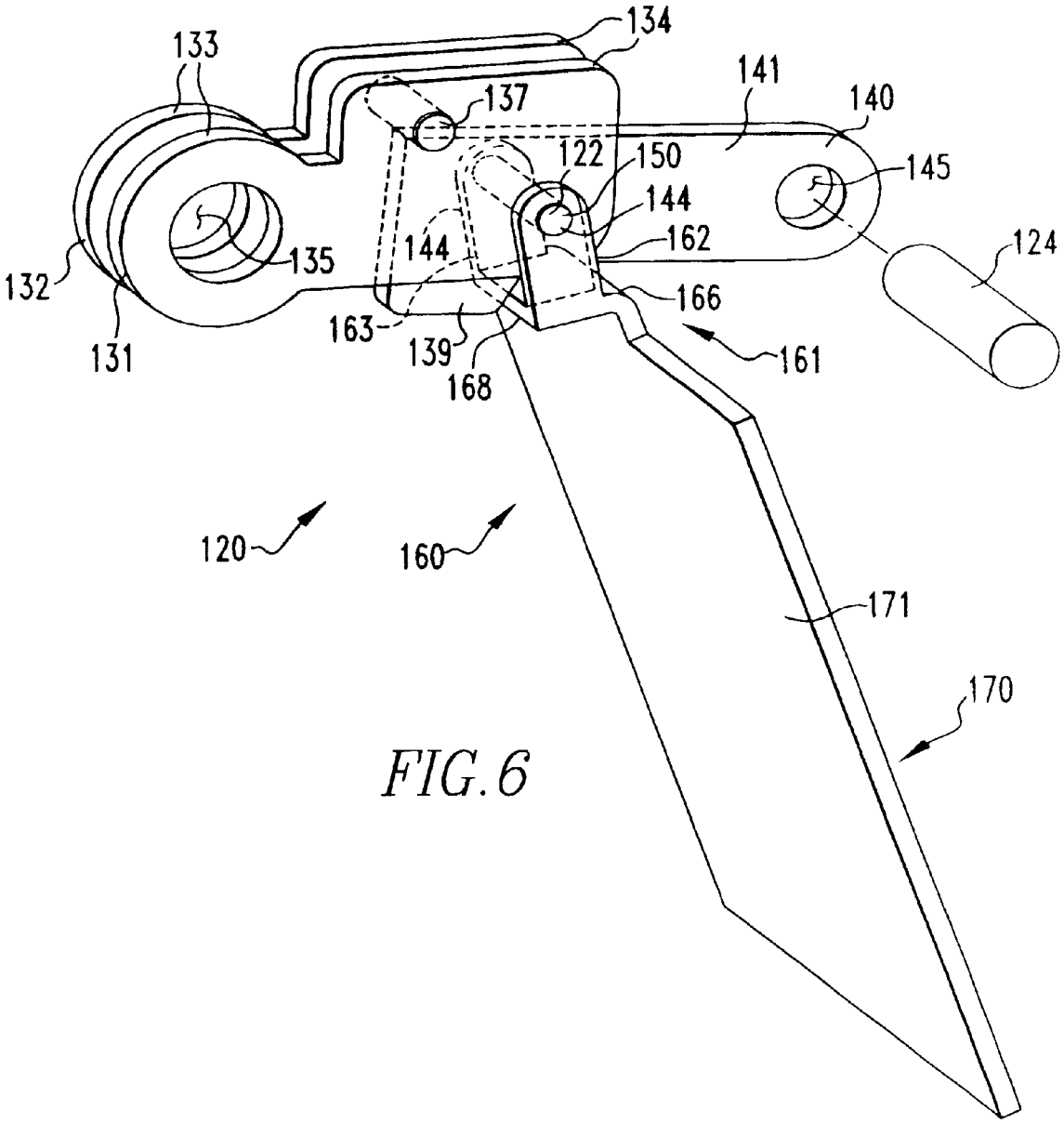
FIG. 6 is an isometric view of the electromagnetic blow-open device.

When assembled, as shown in FIG. 6, the electromagnetic blow-open device 120 has actuator arm attachment end 161 disposed with tabs 162, 163 on either side of first link assembly 130 with attachment end opening 164 aligned with first link assembly second end openings 136. Second link member second end 144 is then disposed between first link assembly planar members 131, 132 at the second end 134 so that second link assembly second end openings 146 align with first link assembly second end openings 136 and tab openings 164. Pin 122 is then passed through first link assembly second end openings 136, second link assembly second end opening 146, and tab openings 164 thereby forming knee joint 150. Second link member second end 144 is disposed adjacent to the over-toggle stop pin 137. A drive pin 124 structured to engage carrier 27 is disposed in second link assembly first end openings 145. Preferably, the over-toggle position is set at about one to two degrees past the point where imaginary longitudinal centerlines extending through the first link assembly 130 and the second link assembly 140 are parallel.

As shown in FIG. 6, when the electromagnetic blow-open device 120 is assembled, the first link assembly 130 pivots relative to the second link assembly 140 about knee joint 150. Rotation of the first link assembly 130 in the counter-clockwise direction around knee joint 150, as shown in FIG. 6, is limited by over-toggle stop pin 137. The over-toggle stop pin 137 contacts the second link assembly second end 144. When the electromagnetic blow-open device 120 is in the over-toggle position, the electromagnetic blow-open device 120 acts as a rigid member when exposed to a compressive force. Additionally, the actuator arm 160 extends generally perpendicularly to both the first link assembly 130 and the second link assembly 140. The actuator arm shoulders 166 are structured to contact the medial portion of the second link assembly 140. Because the actuator arm shoulders 166 extend away from the actuator arm tabs 162, 163, the shoulders 166 contact the medial portion of the second link assembly 140. The actuator arm crossbar 168 is structured to contact tabs 139.

Figure 7:
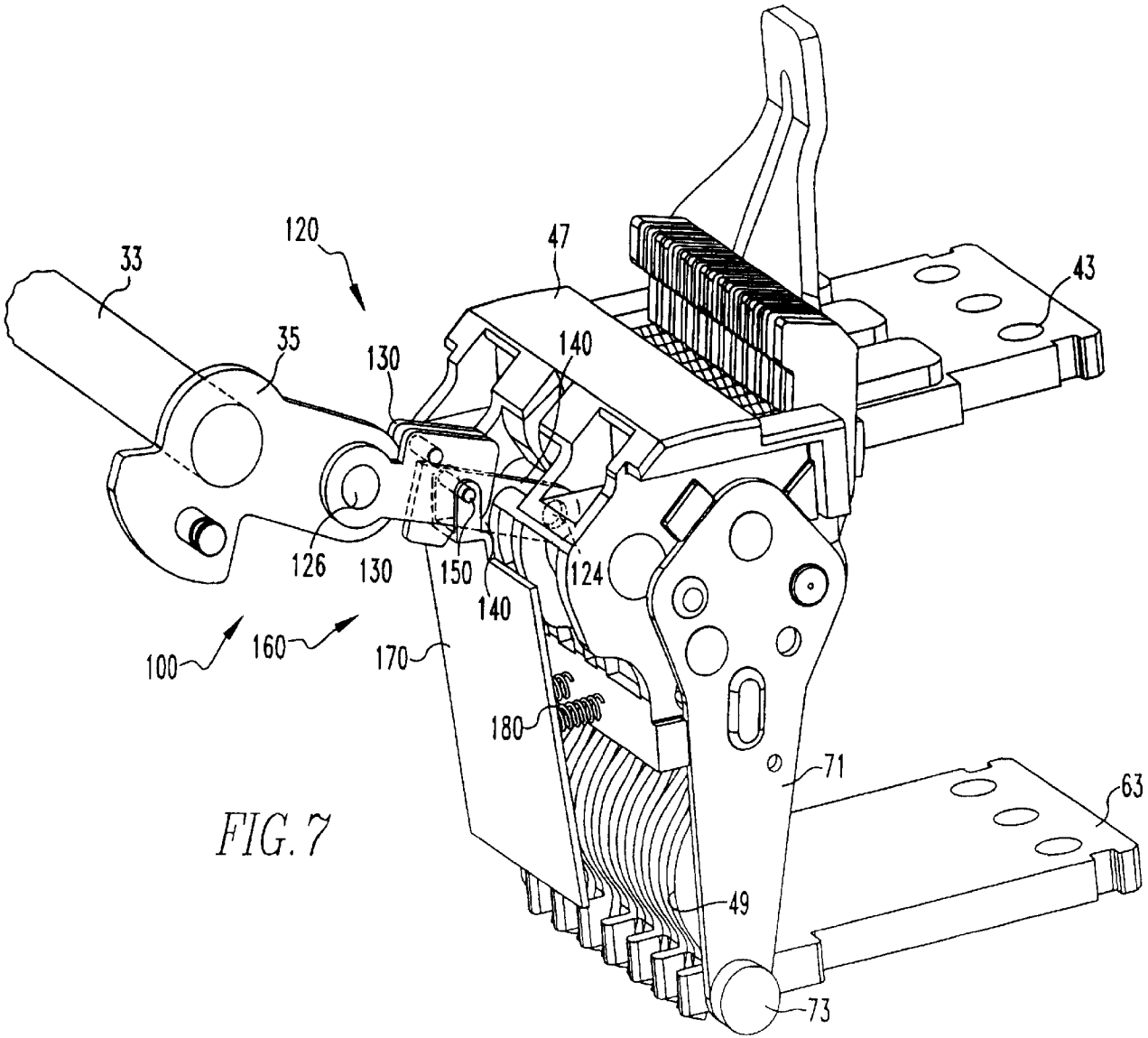
FIG. 7 is an isometric view of a partial view of a circuit breaker pole with the electromagnetic blow-open device in the closed position.

In operation, as shown in FIGS. 2*a* and 7–9, the electromagnetic blow-open device 120 is coupled to the contact carrier 47 by pin 124. The first link assembly 130 is coupled to the pole shaft lobe 35. Pole shaft lobe 35 includes a pin 126 which is structured to engage first link assembly first end openings 135. When the circuit breaker is in the closed position, as shown in FIG. 7, the contact carrier 47 is rotated to the fully closed position and the electromagnetic blow-open device 120 will be in the over-toggle position. The pole shaft 33 will be held in position by the closing mechanism (not shown). Thus, until the unit is tripped by the tripping mechanism, the pole shaft 33 does not rotate. The electromagnetic blow-open device 120 is held in the over-toggle position by the electromagnetic repulsion force between the main contacts 37 and the compressive force of the contact springs 79 which are biasing the contact fingers 49 against the stationary contact 39 and the contact carrier 47 away from the stationary contact 39. However, because the first and second link assemblies 130, 140 are only about one to two degrees past the toggle point when in the over-toggle position, compressive force of the contact springs 79 holding the electromagnetic blow-open device 120 in the over toggle-position is minimal. As is described below, the force preventing the actuating arm 160 from acting on the knee joint 150 is substantially created by the flapper spring 180.

When installed, the actuating arm 160 extends adjacent to, but spaced from, contact fingers 49. As a current passes through the contact fingers 42 a magnetic field is created. The magnetic field attracts the flapper assembly 170. The flapper assembly 170 is maintained in position, under normal operating conditions, by at least one flapper spring 180. The flapper spring 180 extends between the carriage 47 and the rigid metallic member 171. Under normal operating conditions, the magnetic field is not strong enough to overcome the force of the flapper spring 180 and, to a lesser extent contact springs 79, which hold the electromagnetic blow-open device 120 in the over-toggle position. When an over-current condition occurs, however, the strength of the magnetic field increases and draws the flapper assembly 170 towards the contact fingers 49. This additional magnetic force acting on the flapper assembly 170 will cause the actuating arm 160 to act on the knee joint 150 and cause the electromagnetic blow-open device 120 to move out of the over-toggle position. Because the flapper spring 180 creates the force which the over-current magnetic force must overcome in order to trip the electromagnetic blow-open device 120, a change in the over-current tripping point may be affected by changing the strength of the flapper spring 180.

Figure 8:
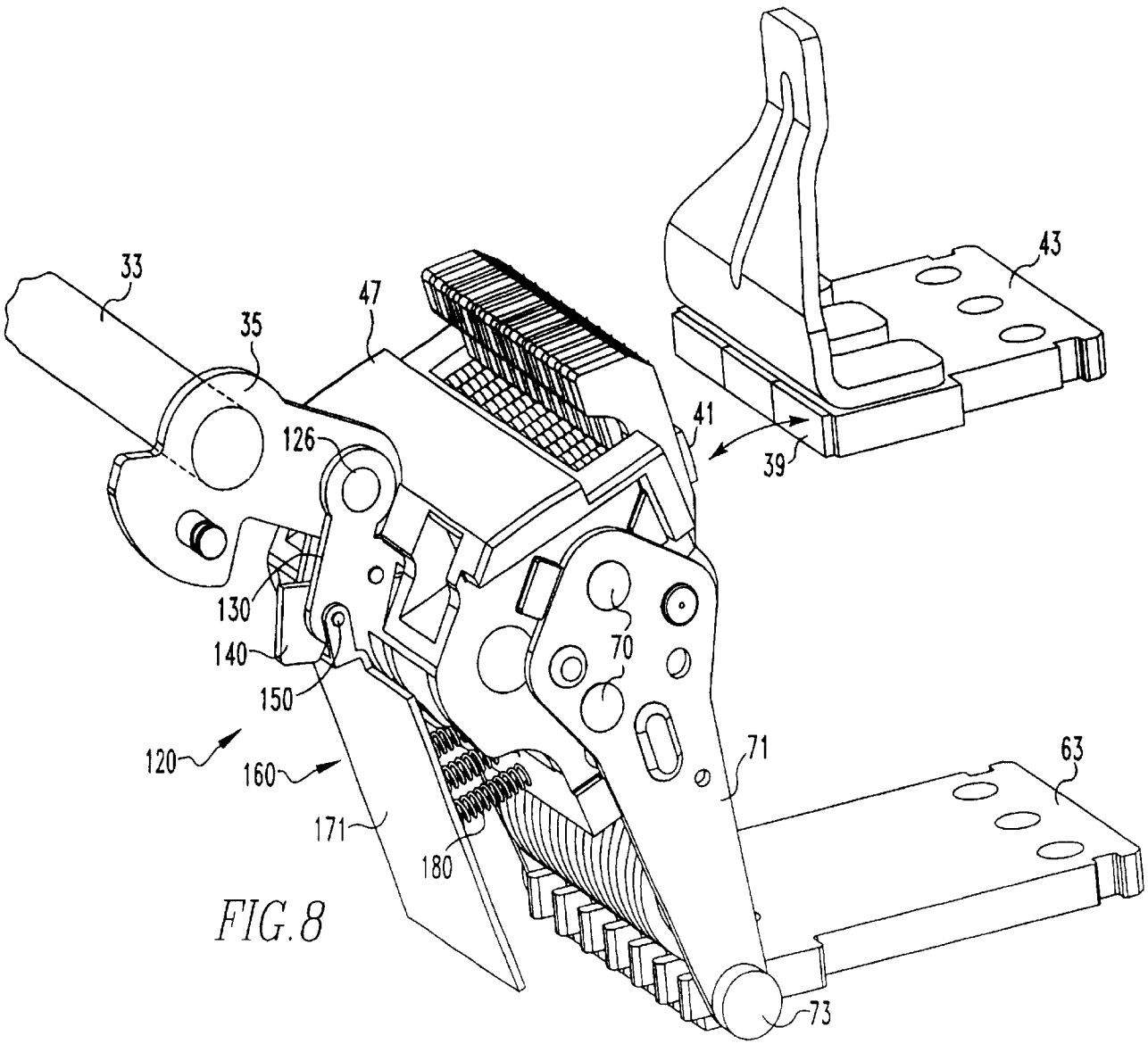
FIG. 8 is an isometric view of a partial view of a circuit breaker pole with the electromagnetic blow-open device in the tripped position.
Figure 9:
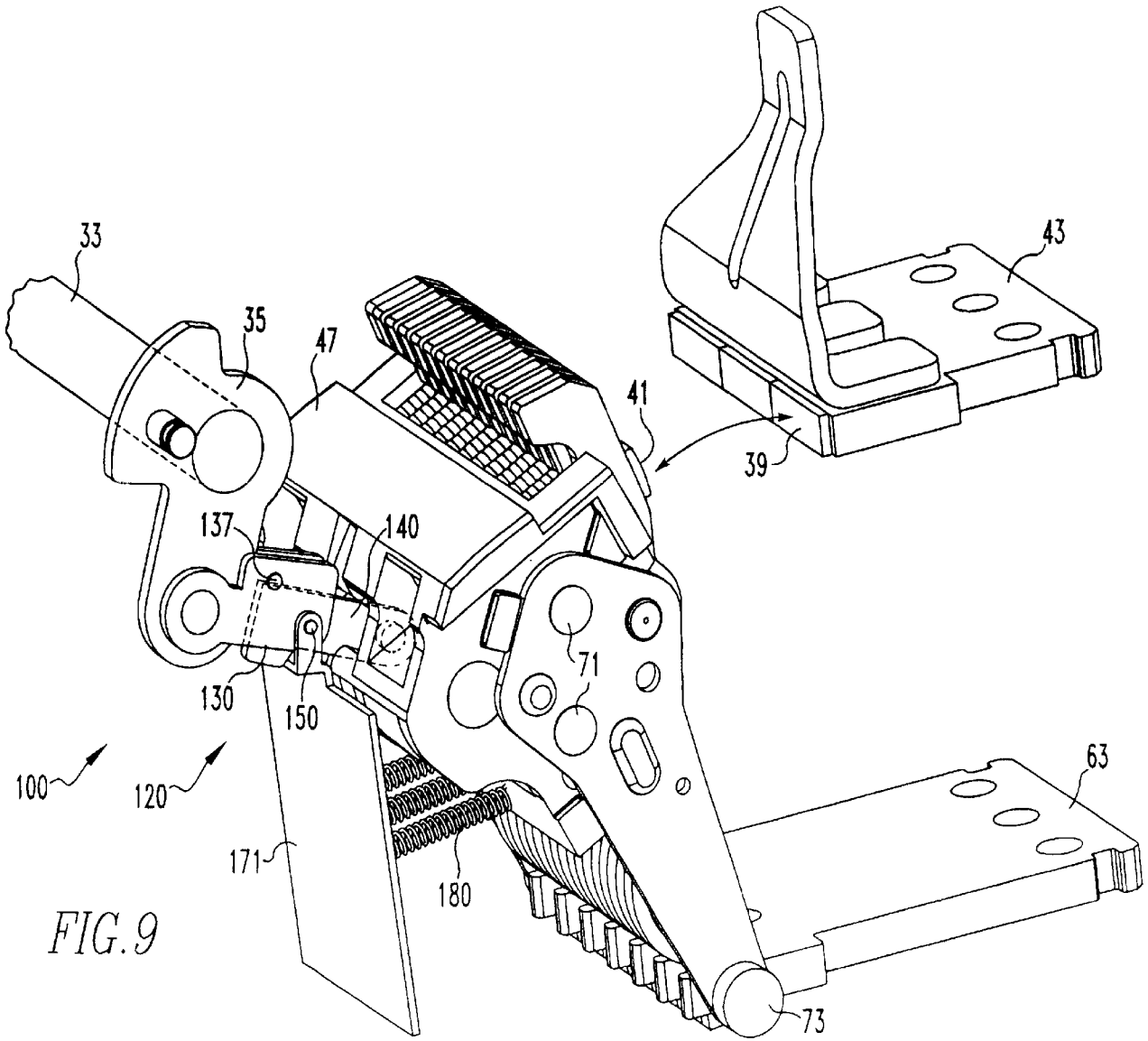
FIG. 9 is an isometric view of a partial view of a circuit breaker pole with the electromagnetic blow-open device in the reset position.

As shown in FIG. 8, once the electromagnetic blow-open device 120 is out of the over-toggle position, the electromagnetic blow-open device 120 will collapse with the first link assembly rotating in a clockwise direction, as shown on FIG. 8, about pin 126. As the electromagnetic blow-open device 120 collapses, the contact carrier 47 is free to move away from the stationary main contact 39 as it pivots about mounting pivots 73. Rotation of the contact carrier 47 is assisted by the force of the contact springs 79 expanding as detailed above. It should be noted that having the electromagnetic blow-open device 120 collapse allows the stationary main contacts 39 and the movable main contacts 41 to separate without the pole shaft 33 moving.

Because the electromagnetic blow-open device 120 is linked to a single pole 10 of the circuit breaker, only an over-current condition in that pole 10 will cause the electromagnetic blow-open device 120 to collapse and open that pole 10. The trip unit is calibrated so that, when any phase current is high enough to trip the electromagnetic blow-open device 120, the trip unit will rotate the pole shaft and separate the remaining poles 10 as detailed in U.S. Pat. No. 6,066,821. As shown in 9, when the pole shaft 33 rotates, lobe 35 will cause the electromagnetic blow-open device 120 to expand and return to the over-toggle position. After the circuit breaker is opened and the links reset, the contacts can then be re-closed by the mechanism as detailed in U.S. Pat. No. 6,066,821.

During the reset procedure as the breaker opens, the first and second link assemblies 130, 140 rotate relative to each other until the longitudinal axis of both link assemblies 130, 140 are generally parallel. That is, knee joint 150 is generally straight. At this point, the knee joint 150 is at the toggle point. Additionally, the flapper springs 180 bias the actuating arm 160 away from the contact carrier so that the crossbar 168 is contacting the first link tab 139. Thus, when the main contacts 39, 41 are open, flapper spring 180 biases the link assemblies 130, 140 into the over-toggle position. Once the link assemblies 130, 140 are in the over-toggle position, they will stay there as the breaker is reclosed and the linkage is exposed to a compressive force created by the contact springs 79. Thus the electromagnetic blow-open device 120 acts as a rigid member during the closing procedure. Closing the main contacts 39, 41 is accomplished by rotating the pole shaft 35 in a counterclockwise direction, as shown in FIG. 2c. Once the main contacts 39, 41 are closed, current flowing through the pole will generate an electromagnetic field that will pull the actuator arm 160 toward the contact fingers 49. Therefore, closing the main contacts 39, 41 will return the electromagnetic blow-open device 120 to the closed position as shown in FIG. 7.

Figure 10:
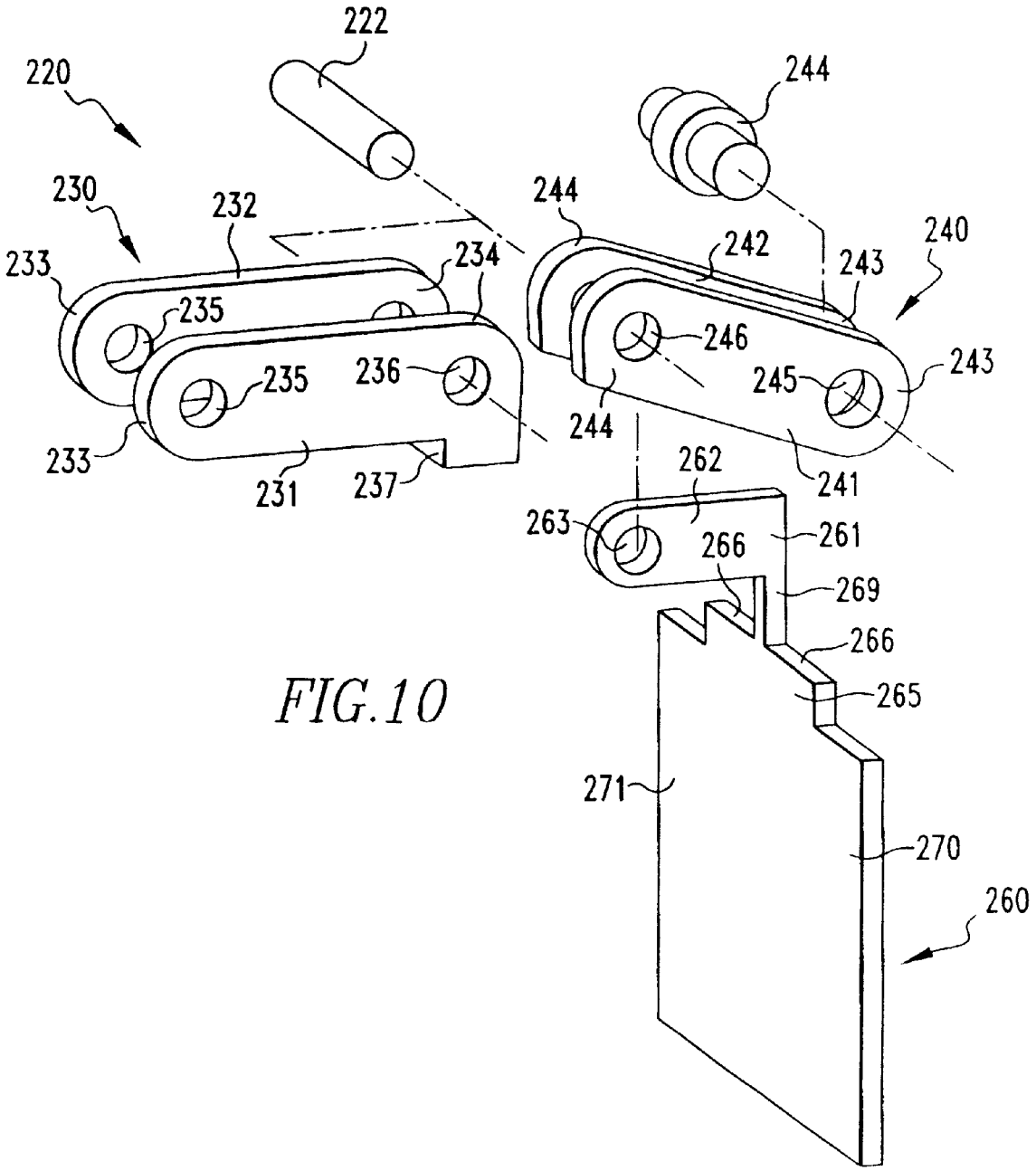
FIG. 10 is an exploded isometric view of an alternate electromagnetic blow-open device.

An alternate electromagnetic blow-open device 220 is shown on FIG. 10. In this embodiment, the electromagnetic blow-open device 220 includes a first link assembly 230 and a second link assembly 240 which are rotatably coupled to each other at a knee joint 250 (FIG. 11) by a pivot pin 222. The first link assembly 230 includes two rigid planar members 231, 232. Each rigid planar member 231, 232 has a first end 233 and a second end 234. Both the first end 233 and the second end have an opening 235, 236 therein structured to allow a pin to pass through either rigid planar member 232, 234. The rigid planar members 232, 234 are coupled to, and held in a spaced, generally parallel relation by, a over-toggle stop 237 disposed at second end 234 of each rigid planar member 232, 234.

The second link assembly 240 includes two rigid planar members 241, 242. Each rigid planar member 241, 242 has a first end 243 and a second end 244. Both the first end 243 and the second end have an opening 245, 246 therein structured to allow a pin to pass through either rigid planar member 242, 244.

The electromagnetic blow-open device 220 also includes a actuator arm 260. The actuator arm includes an attachment end 261 having a tab 262 with an opening 263 therethrough. The actuator arm 260 further includes a stem portion 264 and a shoulder portion 265 having at least one, and preferably two shoulders 266. The stem portion is coupled to and disposed between the attachment end 261 and the shoulder portion 265. The shoulder portion 265 is further coupled to a flapper assembly 270. The flapper assembly 270 is preferably a flat, rigid metallic member 271. However, as described below, the flapper assembly 270 may have many shapes.

Figure 11:
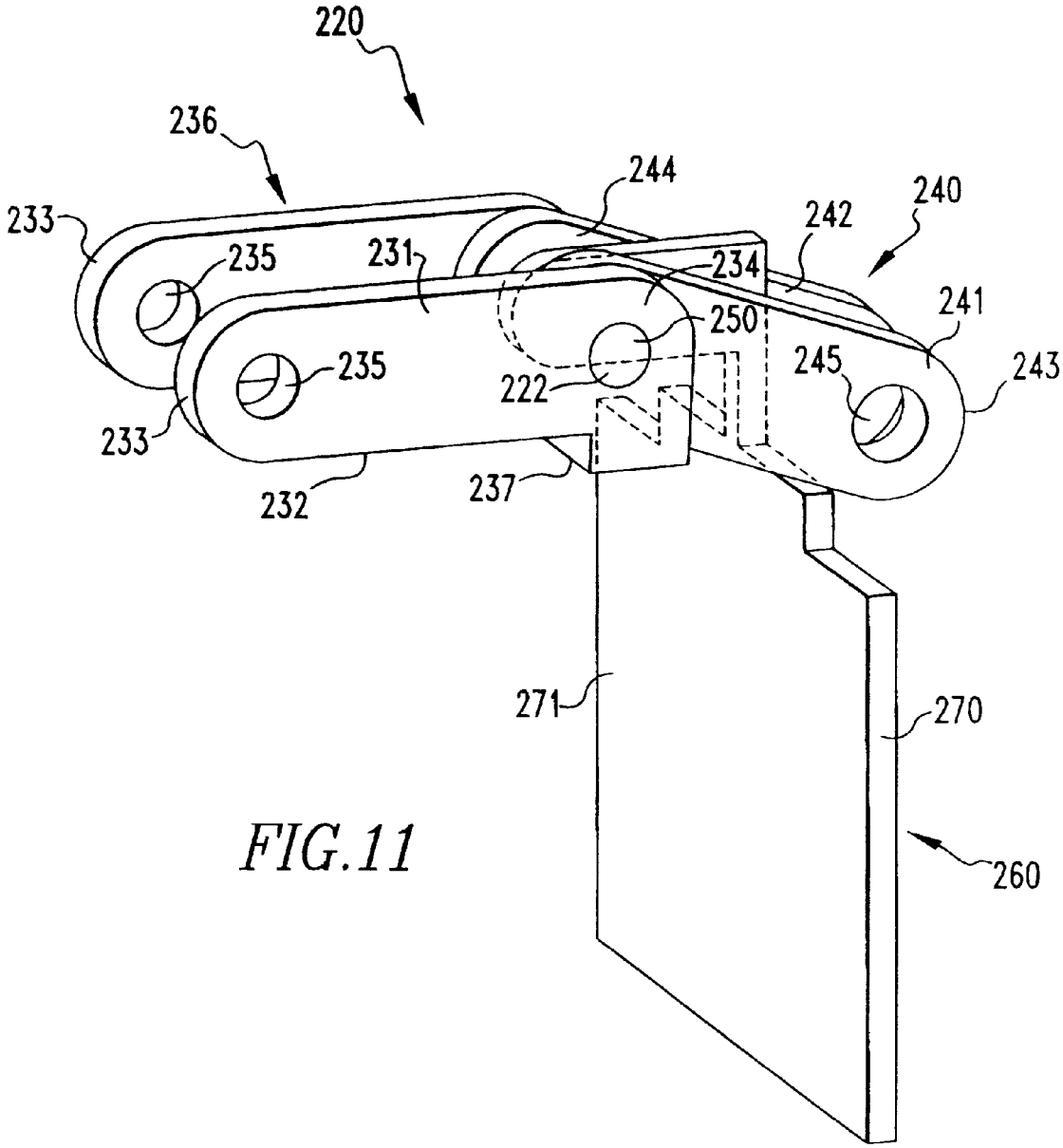
FIG. 11 is an isometric view of the alternate electromagnetic blow-open device of FIG. 10.

When assembled, as shown in FIG. 11, the electromagnetic blow-open device 220 has actuator arm attachment end 261 disposed between second link assembly rigid members 241 and 242 with attachment end opening 263 aligned with second link assembly second end openings 246. Second link assembly second end 244 is then disposed between first link assembly second end 234 so that second link assembly second end openings 246 align with first link assembly second end openings 236. Pin 222 is then passed through first link assembly second end openings 236, second link assembly second end openings 246, and attachment end opening 263 thereby forming knee joint 250. Stem portion 264 extends from between the second link assembly 240 adjacent to over-toggle stop 237. A drive pin 224 structured to engage carrier 27 is disposed in second link assembly first end openings 245.

When the electromagnetic blow-open device 220 is assembled, the first link assembly 230 pivots relative to the second link assembly 240 about knee joint 250. Rotation of the first link assembly 230 in the counter-clockwise direction, as shown in FIG. 6, is limited by over-toggle stop 237. The over-toggle stop 237 contacts the medial portion of the second link assembly 240. Additionally, the actuator arm 260 extends in a direction generally perpendicular to the longitudinal axis of the first link assembly 230 and shoulders 266 contact the medial portion of the second link assembly 240.

Figure 12:
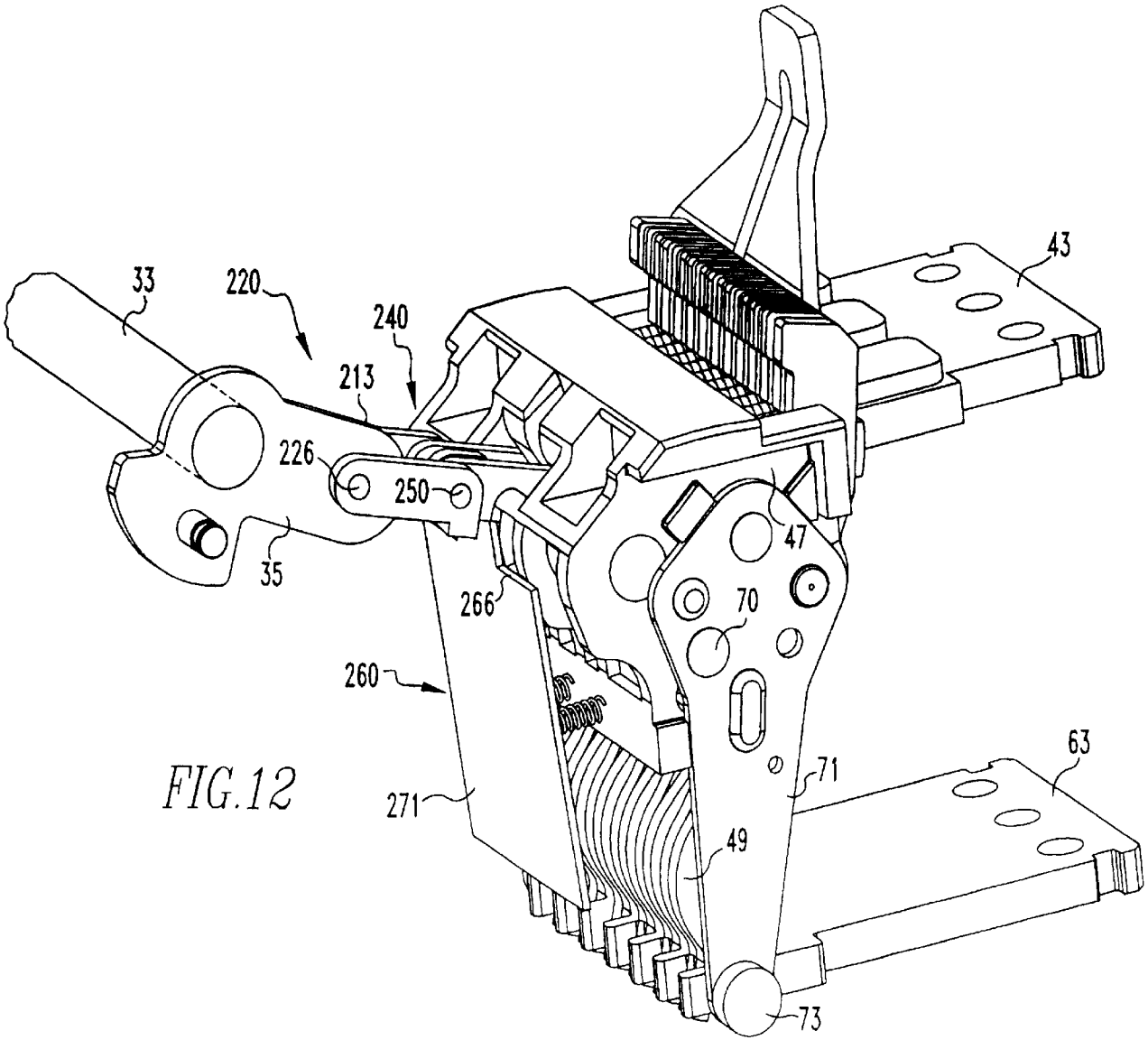
FIG. 12 is an isometric, partial view of a circuit breaker pole with the electromagnetic blow-open device in the closed position.
Figure 13:
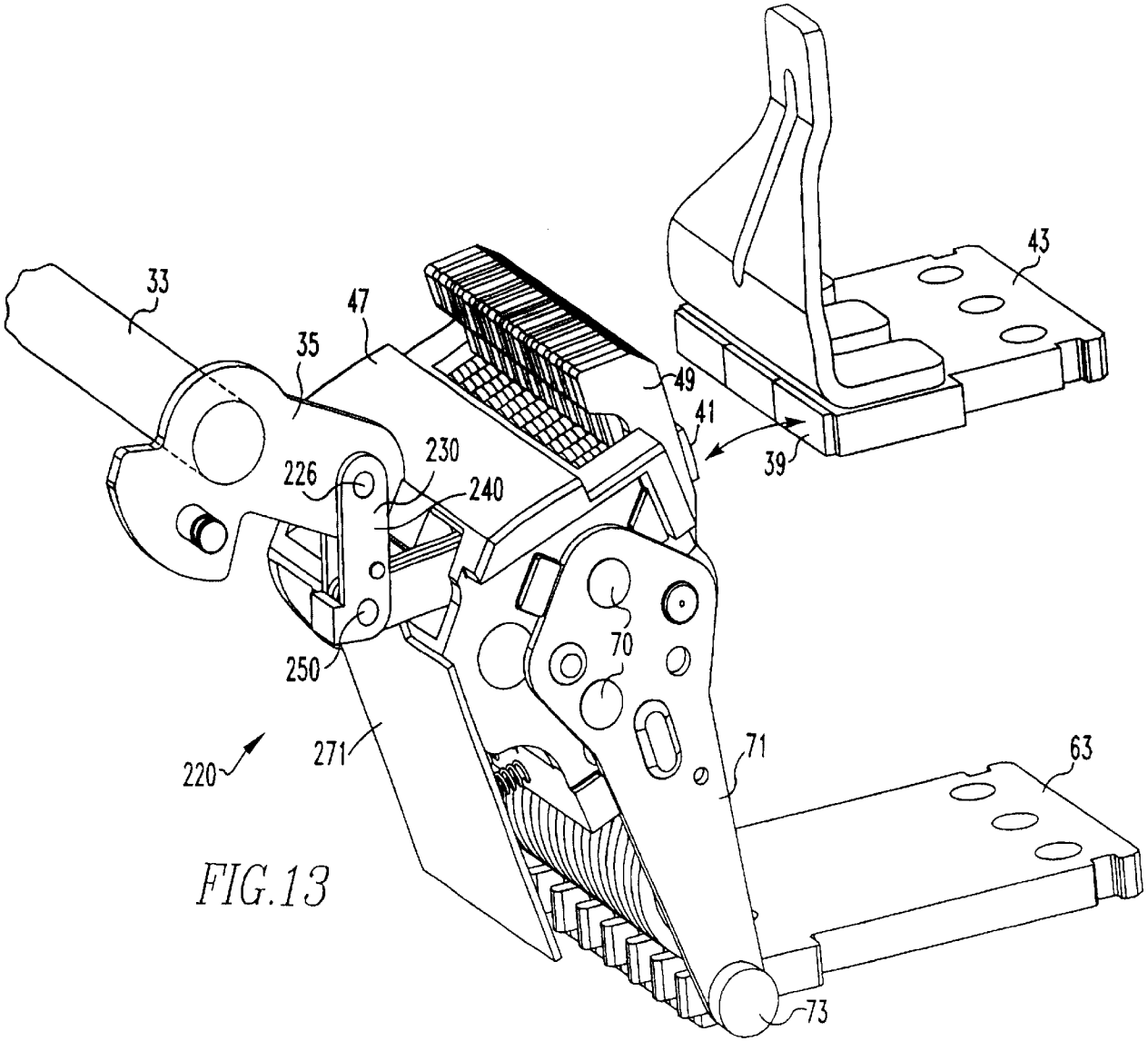
FIG. 13 is an isometric, partial view of a circuit breaker pole with the lectromagnetic blow-open device in the tripped position.
Figure 14:
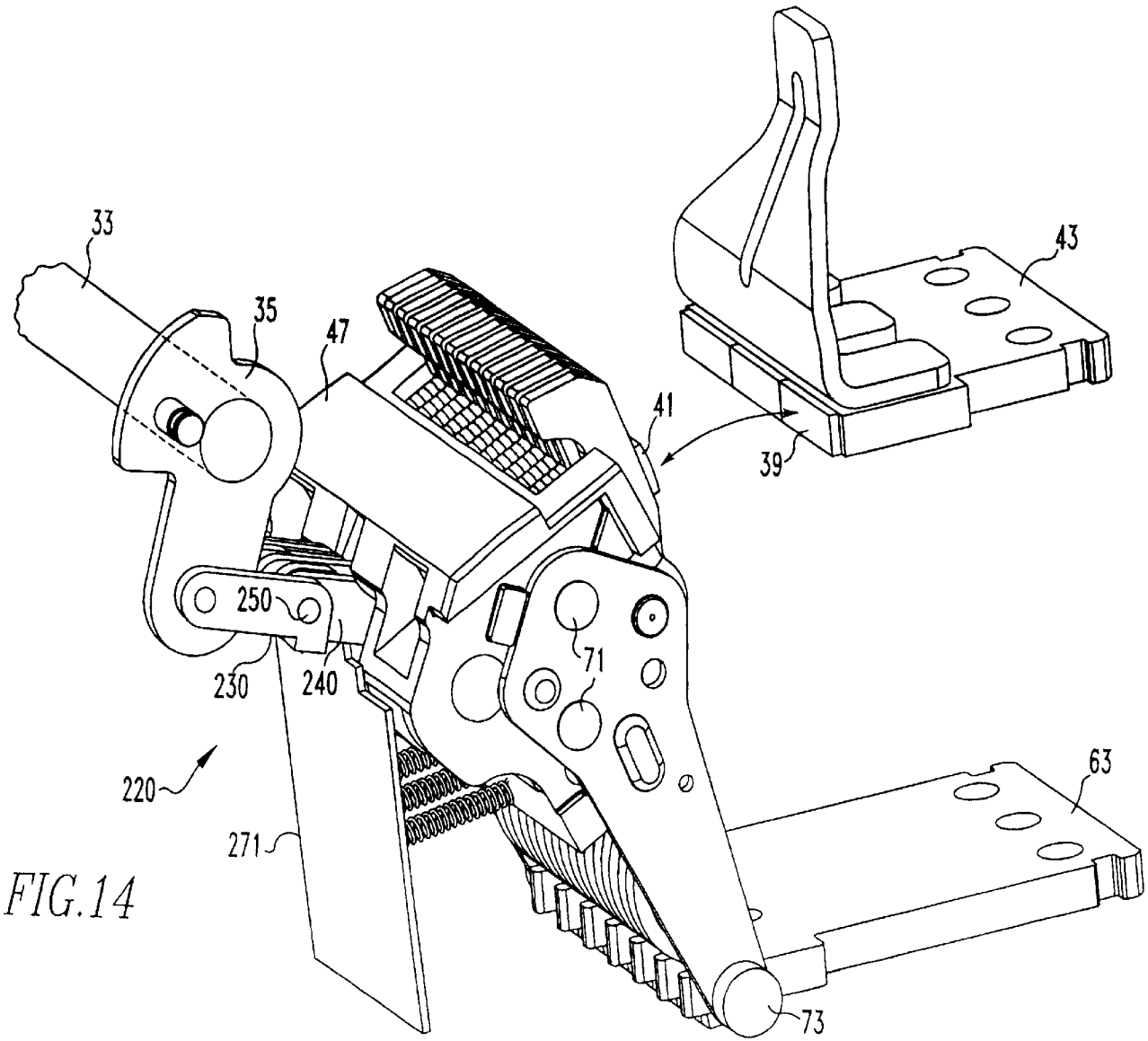
FIG. 14 is an isometric view of a partial view of a circuit breaker pole with the electromagnetic blow-open device in the reset position.

In operation, as shown in FIGS. 12–14, the electromagnetic blow-open device 220 is coupled to the contact carrier 47 by pin 224. The first link assembly 230 is coupled to the pole shaft lobe 35. Pole shaft lobe 35 includes a pin 226 which is structured to engage first link assembly first end openings 235. When the circuit breaker is in the closed position, as shown in FIG. 12, the contact carrier 47 is rotated to the fully closed position and the electromagnetic blow-open device 220 will be in the over-toggle position. The pole shaft 33 will be held in position by the closing mechanism (not shown). Thus, until the unit is tripped by the tripping mechanism, the pole shaft 33 does not rotate. The electromagnetic blow-open device 220 is held in the over-toggle position by the electromagnetic repulsion force between the main contacts 37 and force of the contact springs 79 which are biasing the contact fingers 49 against the stationary contact 39 and the contact carrier 47 away from the stationary contact 39.

When installed, the actuating arm 260 extends adjacent to, but spaced from, contact fingers 49. As a current passes through the contact fingers 42 a magnetic field is created. The magnetic field attracts the flapper assembly 270. Under normal operating conditions, the magnetic field is not strong enough to overcome the force of the contact springs 79 holding the link assembly in the over-toggle position. When an over-current condition occurs, however, the strength of the magnetic field increases and draws the flapper assembly 270 towards the contact fingers 49. The magnetic force resulting from an over-current condition which acts on the flapper assembly 270 will cause the actuating arm 260 to act on the knee joint 250 and cause the electromagnetic blow-open device 220 to move out of the over-toggle position.

As shown in FIG. 13, once the electromagnetic blow-open device 220 is out of the over-toggle position, the electromagnetic blow-open device 220 will collapse with the first link assembly rotating in a clockwise direction, as shown on FIG. 8, about knee joint 250. As the electromagnetic blow-open device 220 collapses, the contact carrier 47 is free to move away from the stationary main contact 39. Rotation of the contact carrier 47 is assisted by the force of the contact springs 79 expanding as detailed above. Again, it should be noted that having the electromagnetic blow-open device 220 collapse allows the stationary main contacts 39 and the movable main contacts 41 to separate without the pole shaft 33 moving.

As shown in 14, when the pole shaft 33 rotates, lobe 35 will cause the electromagnetic blow-open device 220 to expand and return to the over-toggle position. After the circuit breaker is tripped, the contacts will be closed by the reset mechanism as detailed in U.S. Pat. No. 6,066,821. During the closing procedure, the electromagnetic blow-open device 220 is exposed to a compressive force created by the contact springs 79, thus the electromagnetic blow-open device 120 acts as a rigid member. Closing the main contacts 39, 41 will return the electromagnetic blow-open device 220 to the closed position as shown in FIG. 12.

Figure 15:
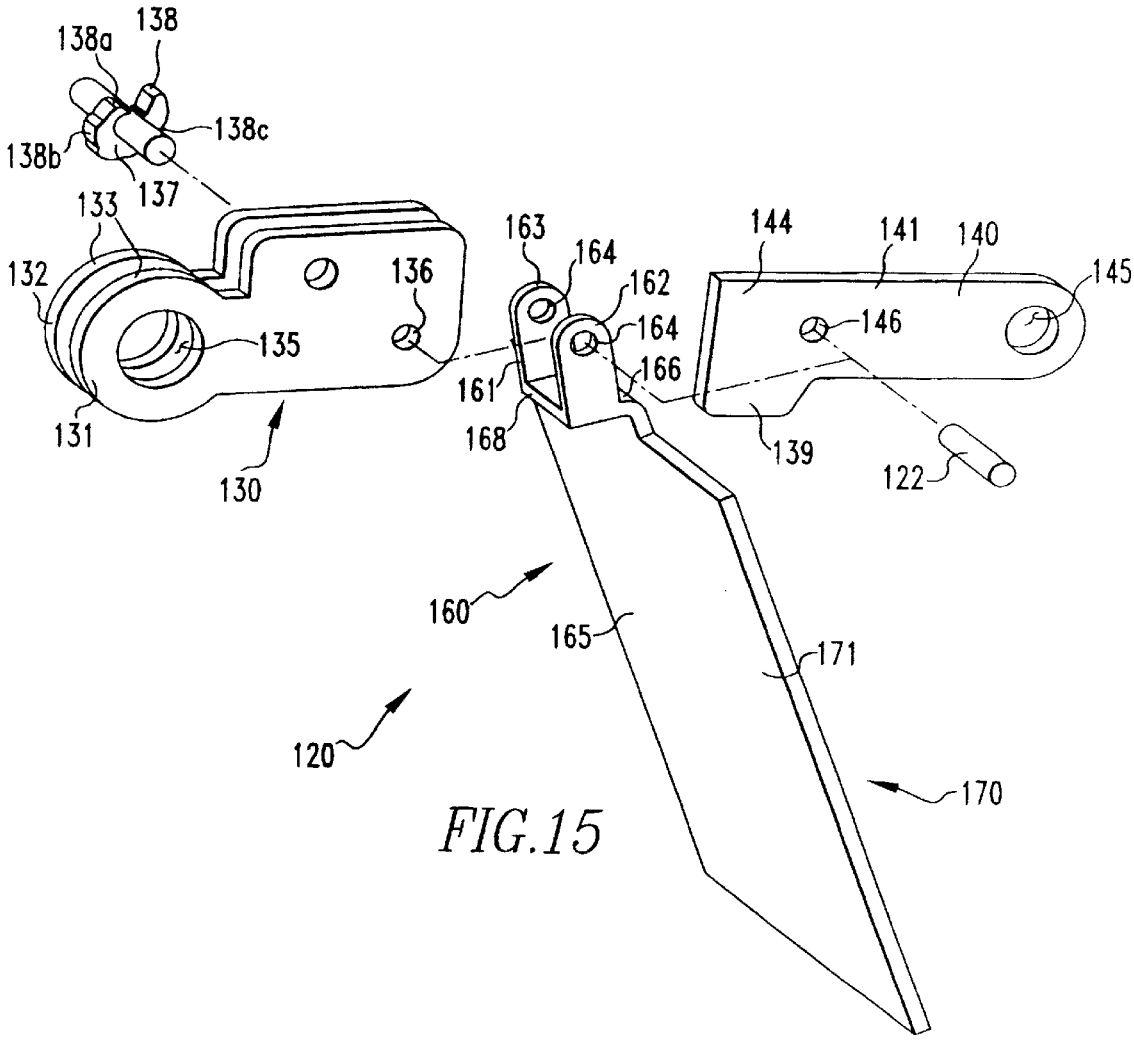
FIG. 15 is an exploded view of the electromagnetic blow-open device with an adjustable cam on the over-toggle stop pin.

As shown in FIG. 15, the over-toggle stop pin 137 may include a cam surface 138. The cam surface 138 may include steps 138*a*, 123*b*, 138*c*. The cam surface is structured to contact second link assembly second end 144. The over-toggle stop pin 137 also includes a latch means, such as, but not limited to, a detent (not shown) for selectively positioning the cam surface 138 relative to the first link assembly 130. The over-toggle stop pin 137 may also include indicia relating the position of the cam surface 138 to selected over-current conditions. As the over-toggle stop pin 137 is rotated relative to the first link assembly 130, the relative angle between the first link assembly 130 and the second link assembly 140 changes. Thus, the trip condition of the electromagnetic blow-open device 120 changes as well.

Alternately, the over-current condition may be determined by the angular relationship between said first link and said second link in said over-toggle position. In the preferred embodiment, the relative angle between the link assemblies 130, 140 is the angle between an imaginary line extending through the longitudinal axis of the first link assembly 130 and an imaginary line extending through the longitudinal axis of the second link assembly 140. Preferably, the relative angle will be almost zero, and more preferably within 0.1 to 2 degrees of each other. The greater the relative angle between the link assemblies 130, 140, the greater the force required to move the electromagnetic blow-open device 120 out of the over-toggle position. Thus, by structuring the link assembly to have a greater relative angle, the amount of current required to trip the electromagnetic blow-open device 120 will be increased.

The strength of the force acting on the electromagnetic blow-open device 120 from the actuator arm 160 is a function of the area of the flapper assembly 170 and the proximity of the flapper assembly 170 to the contact fingers 42. As such, the over-current condition may be changed by changing the size of the flapper assembly 170 or the proximity of the flapper assembly 170 to the contact fingers 42. This may be accomplished by means, such as an expandable flapper assembly 170 or by pivoting the flapper assembly 170, which would be obvious to those skilled in the art.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An electromagnetic blow-open device for a pole of a circuit breaker, said pole having a stationary contact and a movable contact having contact fingers mounted on a contact carrier, said contacts having an open position and a closed position, said pole further having an associated rotatable pole shaft, said electromagnetic blow-open device comprising:

a collapsible linkage having a rigid position and a changeable position;

said collapsible linkage disposed between, and coupled to, said pole shaft and said contact carrier;

said collapsible linkage maintaining said stationary contact and said movable contact in said closed position while said collapsible linkage is in said rigid position and to allow said stationary contact and movable contact to move to said open position when said collapsible linkage is in said changeable position;

an actuator arm coupled to said collapsible linkage and responsive to an over-current condition in said pole;

said actuator arm structured to shift said collapsible linkage from said rigid position to said changeable position.

2. The electromagnetic blow-open device of claim 1, wherein said collapsible linkage allows said stationary contact and movable contact to move to said open position without said pole shaft rotating.

3. The electromagnetic blow-open device of claim 1, wherein said collapsible linkage is structured to move said contact carrier in response to rotation in said pole shaft when said collapsible linkage is in said rigid position.

4. The electromagnetic blow-open device of claim 3 wherein:

said collapsible linkage includes a plurality of link elements coupled together;

one of said plurality of link elements having an over-toggle stop means; and said collapsible linkage being in said rigid position when a second link element adjacent to said link element having said over-toggle stop means contacts said over-toggle stop means.

5. The electromagnetic blow-open device of claim 4 wherein:

one of said plurality of link elements is a first link assembly having an over-toggle stop;

another one of said plurality of link elements is a second link assembly;

said first link assembly and second link assembly pivotally coupled together forming a knee joint and having an over-toggle position;

wherein said first link assembly is coupled to said pole shaft and said second link assembly is coupled to said carrier assembly an actuator arm having a flapper assembly;

said actuator arm is coupled to said knee joint so that said flapper assembly extends adjacent to said contact fingers.

6. The electromagnetic blow-open device of claim 5, wherein said carrier assembly is pivotally coupled to said circuit breaker, and wherein:

said first link assembly and said second link assembly are structured to maintain said knee joint in said over-toggle position when a current is flowing through said pole; and said actuator arm acts on said knee joint to bring said knee joint out of said over-toggle position when an over-current condition occurs in said pole.

7. The electromagnetic blow-open device of claim 6 wherein:

said first link assembly includes an over-toggle stop pin, and a first member and a second member each having a first end and a second end;

said first member and second member second end having openings therethrough;

said knee-joint includes a pivot pin;

said first link assembly first member and first link assembly second member maintained in spaced, generally parallel relation by said over-toggle stop pin;

said second link assembly includes a member having a first end and a second end;

said second link assembly member second end having an opening therethrough;

said pivot pin extending through said first link assembly first member and first link assembly second member second end openings and said second link assembly member second end opening, thereby forming said knee joint.

8. The electromagnetic blow-open device of claim 6, wherein said carrier assembly is biased away from said stationary contact by contact springs, and wherein:

said first link assembly and said second link assembly are structured to collapse toward each other when moved out of the over-toggle position; and said carrier is structured to pivot away from said stationary contact when said first link assembly and said second link assembly collapse toward each other.

9. The electromagnetic blow-open device of claim 8 wherein:

said first link assembly includes an over-toggle stop pin, and a first member and a second member each having a first end and a second end;

said first member and second member second end having openings therethrough;

said knee-joint includes a pivot pin;

said first link assembly first member and first link assembly second member maintained in spaced, generally parallel relation by said over-toggle stop pin;

said second link assembly includes a member having a first end and a second end;

said second link assembly member second end having an opening therethrough;

said pivot pin extending through said first link assembly first member and first link assembly second member second end openings and said second link assembly member second end opening, thereby forming said knee joint.

10. The electromagnetic blow-open device of claim 9 wherein said second link assembly member contacts said over-toggle stop pin when said first link assembly and second link assembly are in said over-toggle position.

11. The electromagnetic blow-open device of claim 10 wherein:

said actuator arm includes a shoulder portion and at least one tab having an opening therein;

said pivot pin passing through said tab opening; and said shoulder contacting said second link assembly.

12. The electromagnetic blow-open device of claim 11 wherein said flapper assembly includes a rigid metallic member.

13. The electromagnetic blow-open device of claim 12 wherein said flapper assembly includes a means for changing a surface area of said rigid metallic member.

14. The electromagnetic blow-open device of claim 13 wherein said means for changing the surface area of said rigid metallic member includes two rigid metallic members slidably coupled to each other.

15. The electromagnetic blow-open device of claim 13 wherein said means for changing the surface area of said rigid metallic member includes a plurality of rigid metallic members coupled to each other at a common pivot.

16. The electromagnetic blow-open device of claim 12 wherein said flapper assembly includes a means for changing a proximity of said rigid metallic member to said contact fingers.

17. The electromagnetic blow-open device of claim 16 wherein said means for changing the proximity of said rigid metallic member to said contact fingers includes a pivot disposed between said actuator arm and said flapper assembly.

18. Electrical switching apparatus comprising:

a housing;

a pole shaft disposed in said housing;

at least one pole comprising:

a first conductor having at least one stationary contact mounted in said housing;

a movable contact having at least one elongated contact finger coupled thereto;

a contact carrier having a pivot pin on which said at least one contact finger is mounted;

a means mounting said contact carrier for movement between a closed position in which said movable contact engages said stationary contact and an open position in which the movable contact is spaced from said stationary contact;

a biasing means coupled to said contact carrier, biasing said contact carrier into said open position; electromagnetic blow-open device comprising:

a collapsible linkage having a rigid position and a changeable position;

said collapsible linkage disposed between, and coupled to, said pole shaft and said contact carrier;

said collapsible linkage maintaining said stationary contact and said movable contact in said closed position while said collapsible linkage is in said rigid position and to allow said stationary contact and movable contact to move to said open position when said collapsible linkage is in said changeable position;

an actuator arm coupled to said collapsible linkage and responsive to an overcurrent condition in said pole;

said actuator arm structured to shift said collapsible linkage from said rigid position to said changeable position.

19. The electrical switching apparatus of claim 18, wherein said collapsible linkage allows said stationary contact and movable contact to move to said open position without said pole shaft rotating.

20. The electrical switching apparatus of claim 18, wherein said collapsible linkage is moves said contact carrier in response to rotation in said pole shaft when said collapsible linkage is in said rigid position.

21. The electrical switching apparatus of claim 20 wherein:

said collapsible linkage includes a plurality of link elements coupled together;

one of said plurality of link elements having an over-toggle stop means; and said collapsible linkage being in said rigid position when a second link element adjacent to said link element having said over-toggle stop means contacts said over-toggle stop means.

22. The electromagnetic blow-open device of claim 21 wherein:

one of said plurality of link elements is a first link assembly having an over-toggle stop;

one of said plurality of link elements is a second link assembly;

said first link assembly and second link assembly pivotally coupled together forming a knee joint and having an over-toggle position;

wherein said first link assembly is coupled to said pole shaft and said second link assembly is coupled to said carrier assembly an actuator arm having a flapper assembly;

said actuator arm coupled to said knee joint so that said flapper assembly extends adjacent to said contact fingers.

23. The electrical switching apparatus of claim 22, wherein said carrier assembly is pivotally coupled to said circuit breaker, and wherein:

said first link assembly and said second link assembly are structured to maintain said knee joint in said over-toggle position when a current is flowing through said pole; and said actuator arm is structured to act on said knee joint to bring said knee joint out of said over-toggle position when an over-current condition occurs in said pole.

24. The electrical switching apparatus of claim 23 wherein:

said first link assembly includes an over-toggle stop pin, and a first member and a second member each having a first end and a second end;

said first member and second member second end having openings therethrough;

said knee-joint includes a pivot pin;

said first link assembly first member and first link assembly second member maintained in spaced, generally parallel relation by said over-toggle stop pin;

said second link assembly includes a member having a first end and a second end;

said second link assembly member second end having an opening therethrough;

said pivot pin extending through said first link assembly first member and first link assembly second member second end openings and said second link assembly member second end opening, thereby forming said knee joint.

25. The electrical switching apparatus of claim 23, wherein said carrier assembly is biased away from said stationary contact by contact springs, and wherein:

said first link assembly and said second link assembly are structured to collapse toward each other when moved out of the over-toggle position; and said carrier is structured to pivot away from said stationary contact when said first link assembly and said second link assembly collapse toward each other.

26. The electrical switching apparatus of claim 25 wherein:

said first link assembly includes an over-toggle stop pin, and a first member and a second member each having a first end and a second end;

said first member and second member second end having openings therethrough;

said knee-joint includes a pivot pin;

said first link assembly first member and first link assembly second member maintained in spaced, generally parallel relation by said over-toggle stop pin;

said second link assembly includes a member having a first end and a second end;

said second link assembly member second end having an opening therethrough;

said pivot pin extending through said first link assembly first member and first link assembly second member second end openings and said second link assembly member second end opening, thereby forming said knee joint.

27. The electrical switching apparatus of claim 26 wherein said second link assembly member contacts said over-toggle stop pin when said first link assembly and second link assembly are in said over-toggle position.

28. The electrical switching apparatus of claim 27 wherein:

said actuator arm includes a shoulder portion and at least one tab having an opening therein;

said pivot pin passing through said tab opening; and said shoulder contacting said second link assembly.

29. The electrical switching apparatus of claim 28 wherein said flapper assembly includes a rigid metallic member.

30. The electrical switching apparatus of claim 29 wherein said flapper assembly includes a means for changing a surface area of said rigid metallic member.

31. The electrical switching apparatus of claim 30 wherein said means for changing the surface area of said rigid metallic member includes two rigid metallic members slidably coupled to each other.

32. The electrical switching apparatus of claim 30 wherein said means for changing the surface area of said rigid metallic member includes a plurality of rigid metallic members coupled to each other at a common pivot.

33. The electrical switching apparatus of claim 29 wherein said flapper assembly includes a means for changing a proximity of said rigid metallic member to said contact fingers.

34. The electrical switching apparatus of claim 33 wherein said means for changing the proximity of said rigid metallic member to said contact fingers includes a pivot disposed between said actuator arm and said flapper assembly.

* * * * *